United States Patent [19]

Best

[11] 3,976,125

[45] Aug. 24, 1976

[54] THERMAL BLEED FOR PERMAFROST ENVIRONMENTS

[75] Inventor: John S. Best, Midland, Mich.

[73] Assignee: The Dow Chemical Company, Midland, Mich.

[22] Filed: Sept. 21, 1973

[21] Appl. No.: 399,662

Related U.S. Application Data

[62] Division of Ser. No. 291,815, Sept. 25, 1972, Pat. No. 3,804,543, which is a division of Ser. No. 112,635, Feb. 4, 1971, Pat. No. 3,722,378.

[52] U.S. Cl. ..... 165/45; 165/104 S; 165/105

[51] Int. Cl.[2] ..... F28D 15/00

[58] Field of Search ..... 165/45, 104, 105

[56] References Cited

UNITED STATES PATENTS

| | | | |
|---|---|---|---|
| 2,289,809 | 7/1942 | Sherwood | 165/105 X |
| 2,396,338 | 3/1946 | Newton | 165/104 X |
| 2,825,034 | 2/1958 | Birchard | 165/104 X |
| 3,217,791 | 11/1965 | Long | 165/45 |
| 3,548,930 | 12/1970 | Byrd | 165/104 X |
| 3,749,163 | 7/1973 | Waters | 165/45 X |

*Primary Examiner*—Albert W. Davis, Jr.
*Attorney, Agent, or Firm*—Lloyd E. Hessenaur

[57] ABSTRACT

Trafficked surfaces built on foundations which remain substantially undisturbed during seasonal climatic cycles, particularly in permafrost and near permafrost regions where considerable disturbance of the ground beneath foundations is otherwise common. The foundations include combinations of insulation layers, heat sinks and/or thermal bleeds which dampen and prevent the cyclic climatic seasonal variations from affecting the earthen support under the foundations, in both cut and fill sections, and in embankments and backfills adjacent the sections.

2 Claims, 7 Drawing Figures

THERMAL BLEED FOR PERMAFROST ENVIRONMENTS

This Application is a division of application Ser. No. 291,815, filed Sept. 25, 1972, now U.S. Pat. No. 3,804,543; which in turn is a division of application Ser. No. 112,635, filed Feb. 4, 1971, now U.S. Pat. No. 3,722,378.

DESCRIPTION OF THE INVENTION

This invention concerns itself with trafficked surfaces such as paved or unpaved roadways, airport runways, walkways, railroad foundations and the like. The present invention provides foundations for such trafficked surfaces so that the same are not disturbed by the climatic cycles experienced in regions having significant winter seasons where freezing and/or thawing conditions otherwise disturb the trafficked surface. Some attempts to avoid such problems have been tried with insulation layers alone in both permafrost and non-permafrost regions, in an attempt to keep the ground from freezing below the trafficked surface during the winter, and to prevent permafrost soil from thawing during the summer with attendant settlement of the trafficked surface. However, both of these applications fail to fully satisfy the problems to which they are directed, particularly in borderline areas between seasonal frost and permafrost regions, and in many of the permafrost regions.

Particular problem areas are the permafrost regions found in the middle and southern-middle parts of Alaska, for example, where the permafrost's heat sink capacity is not so great that it can absorb much heat without significant thawing. To prevent such thawing using only insulation, such as a layer of insulating plastic foam as, for example, Styrofoam HI brand expanded polystyrene produced by The Dow Chemical Company, would be impractical since it would have to be so excessively thick to guarantee practically 100% resistance against thawing of the earthen material therebelow. Likewise, in the seasonal frost zone closely adjacent to the permafrost regions where it is desired to keep the ground underneath the foundation from freezing, the average temperature of the ground is so close to the freezing point that only a small amount of cold weather during the winter season would cause it to freeze up. Again, with only an insulation layer, such as the foam described, the layer would have to be so thick in this extreme situation to guarantee no cold penetration to the supporting earthen frost susceptible material so as to be impractical.

Accordingly, it is among the objects of the present invention to provide a construction for trafficked surfaces and adjacent areas which prevents degradation of the same due to the winter freezing in seasonal frost zones and during the summer in permafrost zones and, particularly, in those locations where the permafrost zone and the seasonal frost zone are closely adjacent to one another and the support to trafficked surfaces is a particular problem.

It is among further objects of the present invention to provide supplementation to customary insulation to absorb the deficiencies of the same in preventing degradation of foundation and earthen support for trafficked surfaces and to embankments and backfills adjacent thereto.

Briefly, the primary objects of the present invention are accomplished by supplementing an insulation layer with an artificial heat sink where the natural heat sink capacity of the earthen support is insufficient to avoid significant degradation by varying climatic influences. In the permafrost regions the fluid solution in the heat sink is substantially frozen at the commencement of the warm season and designed with sufficient capacity to absorb excess heat which passes therethrough such that substantially no heat reaches the permafrost located therebelow during that season. In the wintertime the heat absorbed by the heat sink is dumped into the adjacent freezing earth, which then has capacity to receive the same, and eventually into the atmosphere to prepare the heat sink for the next warm season. Thermal bleeds can further supplement heat dissipation in special situations. Embankments, backfills, ditches, and other areas adjacent the trafficked surface can employ heat sinks and/or insulation layers to protect them from climatic disturbances. In the seasonal applications where it is desired to keep the cold during the winter from penetrating the frost susceptible soil beneath the trafficked surface foundation, the heat sink carries a fluid which has a phase change temperature of 32° or greater so that when it reaches its phase change temperature it gives up heat to the penetrating cold from above so that heat is not taken from the frost susceptible soil therebelow. The heat sink in this case is designed to have a heat capacity sufficient to absorb the anticipated heat loss during the winter season.

Yet additional objects and advantages of the present invention are even more apparent when taken in conjunction with the accompanying drawing in which like characters of reference designate corresponding material and parts throughout the several views thereof, in which.

The present invention concerns itself with minimizing the effect of environment on trafficked surface constructions such as roadways, walkways, runways and the like, paved or unpaved; wherein the effect of freezing and thawing can be detrimental to such constructions.

By permafrost is generally meant soil, rock, tundra or other ground or earthen material which is frozen in the winter and which does not completely thaw out during the warmer seasons. A further definition of permafrost can be found in the "Environmental Atlas of Alaska" by Phillip R. Johnson and Charles W. Hartman, published 1969 by Institute by Water Resources, University of Alaska. A permafrost region is where permafrost occurs. A seasonal frost region is generally where the soil, rock, or other ground may be at least partially frozen during the winter but is thawed fully during the warmer seasons, i.e., a non-permafrost zone.

Figure 1:
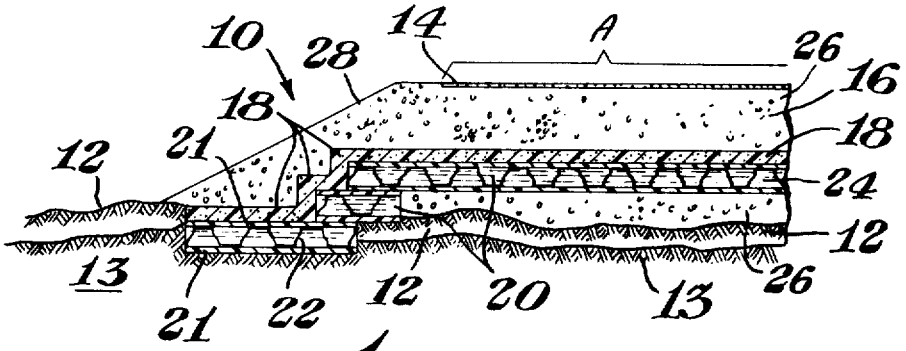
FIG. 1 is a cross half-section of a fill section for a trafficked surface for permafrost regions constructed according to the principles of the present invention.

The applicability of the present invention to a fill section in a permafrost region is illustrated by the half section 10 of FIG. 1, the other half being the mirror image of the half shown. A layer of tundra 12 is located above permafrost ground 13. The major portion of fill section 10 is located on the tundra 12 since it generally is preferable to disturb the tundra layer as little as possible. However, it is sometimes necessary to partially cut away some of the tundra or entirely cut away the tundra down to permafrost ground 13 and the present invention is applicable to each of these situations.

Trafficked or traffic surface 14 can be a roadway, paved or unpaved; a runway surface, paved or unpaved; a footpath, paved or unpaved; a railway or any other trafficked surface. If paved, the pavement can be of asphalt or concrete and if unpaved, it generally can be of gravel or gravel with some filler, chemical or oil treatment to keep down dust. Where a pavement like black asphalt is employed, the design should coincide with the greater solar heat absorbtion which results. Trafficked surface 14 is supported on foundation 16. Foundation 16 includes a layer 18 of highly effective insulation material which is located therebelow a thermal cell or heat sink 20. The insulation layer 18 can be Styrofoam HI brand expanded polystyrene sold by The Dow Chemical Company or other insulation materials which can function in a relatively effective manner.

Thermal cell 20 can comprise various configurations for containing or enveloping a heat sink fluid or material. An embodiment of one such thermal cell is shown in FIG. 1 wherein inner and outer skins 21 are secured on opposite nodular ends of a core structure 22 which core structure, for example, can have a shape such as that shown in U.S. Pat. No. 3,277,598. The core structure primarily is one which separates the two skins and permits fluid flow therethrough and, as such, can also be of bent corrugated metal such as that used in roofing, a granular or other particulate fill, or of other configurations and various materials such as also taught in U.S. Pat. Nos. 3,086,899 and 3,190,142, for example. The member containing the heat sink material should have sufficient impermeability to contain the heat sink material in its fluid state so that substantially none is lost when in such state. The skins 21 can be adhered by adhesives, welded, heat sealed, or otherwise secured with the core 22. The heat sink can be made of plastic materials such as polyethylene or rubber modified polystyrene, but can be formed of other polymeric, metallic, organic, or other synthetic or natural materials and substances having sufficient strength and impermeability to satisfy the requirements of such a thermocell. The compressive forces which such thermocell must withstand are highest during the construction stage of the foundation because after construction the point loading is minimized due to the spreading of loading from the trafficked surface down through the foundation. For example, while forces during construction will depend on the size of machinery used, with normal construction practices for roads the average loading will often be within 40 psi, generally going as high as 80 psi only if large earth moving equipment is used. On the other hand, the subsoil pressure under a finished roadway subject to normal traffic can be in the order of only 10 psi.

A liquid 24 within the thermocell 20 incorporates a freezing point suppressant in water that in solution acts in a eutectic manner in the range of temperatures below 32°F. One such material can be a frozen solution containing less than 5% sodium sulfate. Specifically, a 3.84% solution by weight of sodium sulfate in water has a freezing point of approximately 30°F. Likewise, a 1% propylene glycol solution, by weight, has a freezing point of approximately 30°F. When the liquid is frozen, the heat required to melt the solution is great. The total heat of fusion of the sodium sulfate solution, for example, is available within a few degrees below 32°F., thus allowing reverse cycling of heat flow at less than 32°F. but stopping heat flow at heat source temperatures above 32°F. The heat sink in this particular instance has a thickness (depth) of about twelve inches from skin to skin and is substantially filled with liquid 24. In designing the thermocell 20 care should be taken to allow for expansion and contraction of the liquid 24 as the temperature changes.

For the center portion A of section 10, gravel leveling layer 24 is located above the tundra 12 and the heat sink 20 and insulation 18 are located thereabove. Preferably additional gravel 24 is located above the insulation layer 18, the top surface of which can be the trafficked surface, or can be paved as discussed hereinbefore.

Because of the sloping embankment 28 the insulation layer 18 extends downwardly along the embankment incline and a generally greater capacity (depth) of heat sink 20 is employed to achieve the desired effect. The purpose of section 10 is primarily to prevent permafrost from thawing during the summer months which would otherwise occur during the summer climatic cycle. In some instances permafrost can melt to a depth of several feet, from solar heat. Such melting or permafrost generally makes for a completely impassable condition. Section 10 prevents such thawing. The use of an insulation layer alone is not practical in many places to sufficiently prevent such thawing. The present invention comprises in its preferred embodiment the combination of a heat sink with an insulation layer wherein the thermocell holds a trapped solution which is substantially frozen at the beginning of the summer season, whereby the heat of fusion of the solution then becomes additional heat sink capacity, supplementing that of the permafrost supporting the same. The capacity of the thermocell heat sink is designed such that it will not achieve complete melting until the end of a winter season. Thereafter the winter season refreezes the heat sink solution such that it is ready again for the next summer season. The insulation layer on top of the heat sink prevents an undue quantity of heat from getting to the heat sink, permitting each to be of a practical design. However, during the winter season the insulation layer dampens the freezing effect of the colder season from regenerating the heat sink. But because in permafrost and near permafrost regions the winter season is so severe and longer lasting than the summer season, proper designing of the insulation layer still permits regeneration of the heat sink in the winter while preventing undue heat penetration during the summer.

It is also possible to alter the order of the placement of the insulation in the thermocell but the preferred method is to place the thermocell next to the permafrost. It is also possible to locate a layer of insulation below the thermocell as well as on top of it where conditions are unduly severe or where the permafrost has already been substantially degraded. In the latter instance the insulation layer will permit the degraded area to gradually refreeze and once refrozen to remain the same. Such an arrangement is illustrated by the insulation layer 45 shown in FIG. 3, for example.

The embankment problem is greater than that of the center of the foundation since the cover over the permafrost layer decreases as the embankment leaves the traffic surface 14 and approaches the tundra 12. To compensate for the decreasing lack of cover, the insulation layers and/or the heat sinks have to be increased in capacity, due to the decreased resistance to heat penetration through the gravel cover to the permafrost during the summer.

A specific example of a typical fill section constructed according to this invention, like fill section 10, has been taken for a situation where without any protection the permafrost would thaw to a maximum depth of at least five feet during the summer season. In prior art practice it normally would have taken at least a 14 foot depth of gravel to completely eliminate the thawing of the permafrost in such instance. In computing the effect of insulation, heat sink, and gravel according to this invention, the following properties were employed:

| Material | Thermal Diffusivity ($ft^2/hr$) | Latent heat (BTU/lb.) | Density ($lb/ft^3$) |
|---|---|---|---|
| Frozen Permafrost | 0.0465 | 21.6 | 118.6 |
| Thawed Permafrost | 0.0232 | 21.6 | 118.6 |
| Gravel | 0.034 | 0 | 128 |
| Frozen fluid in sink | 0.0467 | 144 | 56.1 |
| Thawed fluid in sink | 0.00466 | 144 | 62.4 |

Thermal conducitivity of insulation = 0.020 BTU/hr/ft°F.

Mean annual air temperature = $30 + 24.2 \sin\left(\frac{2\pi t}{365} - 1.98\right)$ (used as surface temperature where "t" is time in days)

Freezing point of sink fluid = 30°F.

Figure 7:
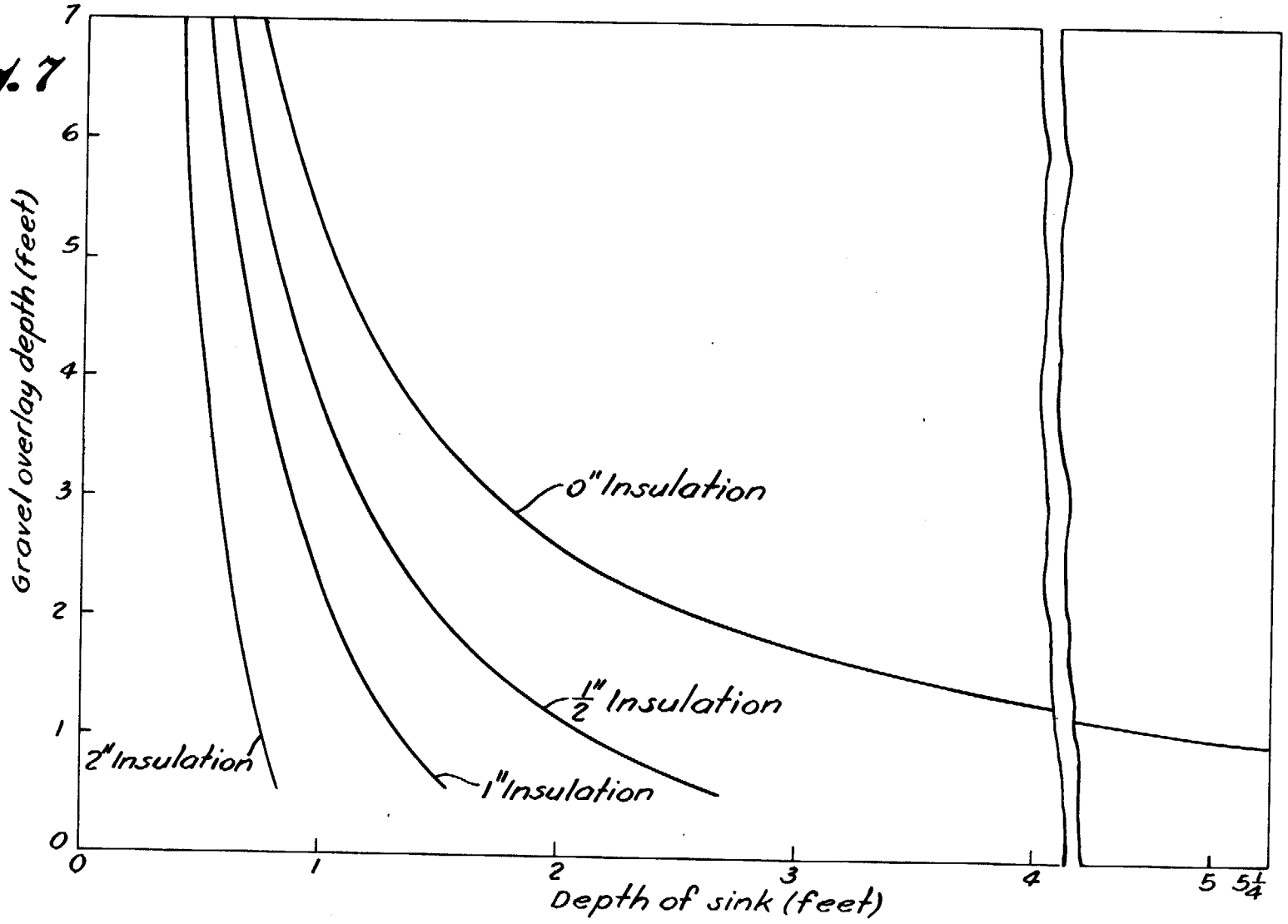
FIG. 7 is a graphical representation of the advantages of a specific example of the present situation.

Considering that there may be some conduction by fluid motion in the heat sink, which can be kept to a minimum by use of some congealant such as methylcellulose or some other cellulose or like material added to the liquid 24, and ignoring the added insulation effect or melted liquid 24 after it thaws, so that the calculations are conservative, the computed relative effects are shown in the Graph of FIG. 7. At one end it can readily be appreciated that with one foot of gravel an impractical 5¼ foot deep sink would be required with no insulation layer to prevent thawing of the permafrost layer. At the other end, even with seven feet of gravel and two inches of insulation some heat sink (greater than ¼ foot in depth) is required to prevent thawing of the permafrost. Ideally some combination in between is the most advantageous practical solution to the situation, which is permitted by employing the concepts of this invention.

Figure 2:
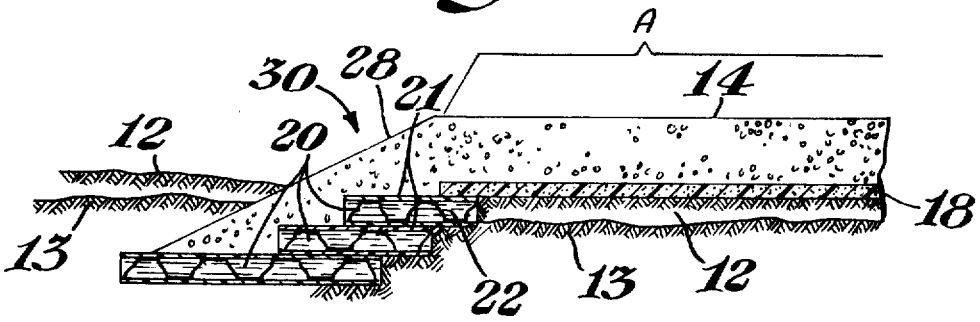
FIG. 2 is a cross half-section like FIG. 1 only showing a modified form thereof.

Another advantage of the insulation heat sink combination of this invention over that of pure insulation is that the heat sink can more readily refreeze permafrost that has been thawed. The size of the heat sink, of course, varies directly with the thickness of the insulating layer as its purpose is to absorb any heat which flows through the insulating layer. It appears clear that if there were no insulation in this instance the sink would have to be impractically large to take care of total elimination of permafrost thawing or the insulation layer or gravel layer would have to be impractically thick to accomplish the same purpose.

Where conditions are not as sensitive as that contemplated by section 10 it may be possible to employ a section 30 as illustrated in FIG. 2. Here the insulation layer 18 is effective enough to prevent thawing during a reasonably short summer cycle where the temperatures do not get too high, such as found in the northern parts of Alaska. In this case the natural heat sink capacity of the ground in the center section A is able to generally accept the heat which might come through the insulation layer 18 without undue degradation of the tundra 12 and permafrost 13. The side effects along the embankments 28 can adequately be taken care of by heat sinks 20 alone. The heat sinks 20 need not be impractical in size even though they may be used generally without an insulation layer, because of the generally frigid climate and short summer season. An overlapping of the insulation layer 18 and the upper heat sink 20 is generally preferred underneath the edge of the traffic surface 14 to provide a desirable transition between the two permafrost protective systems.

Figure 3:
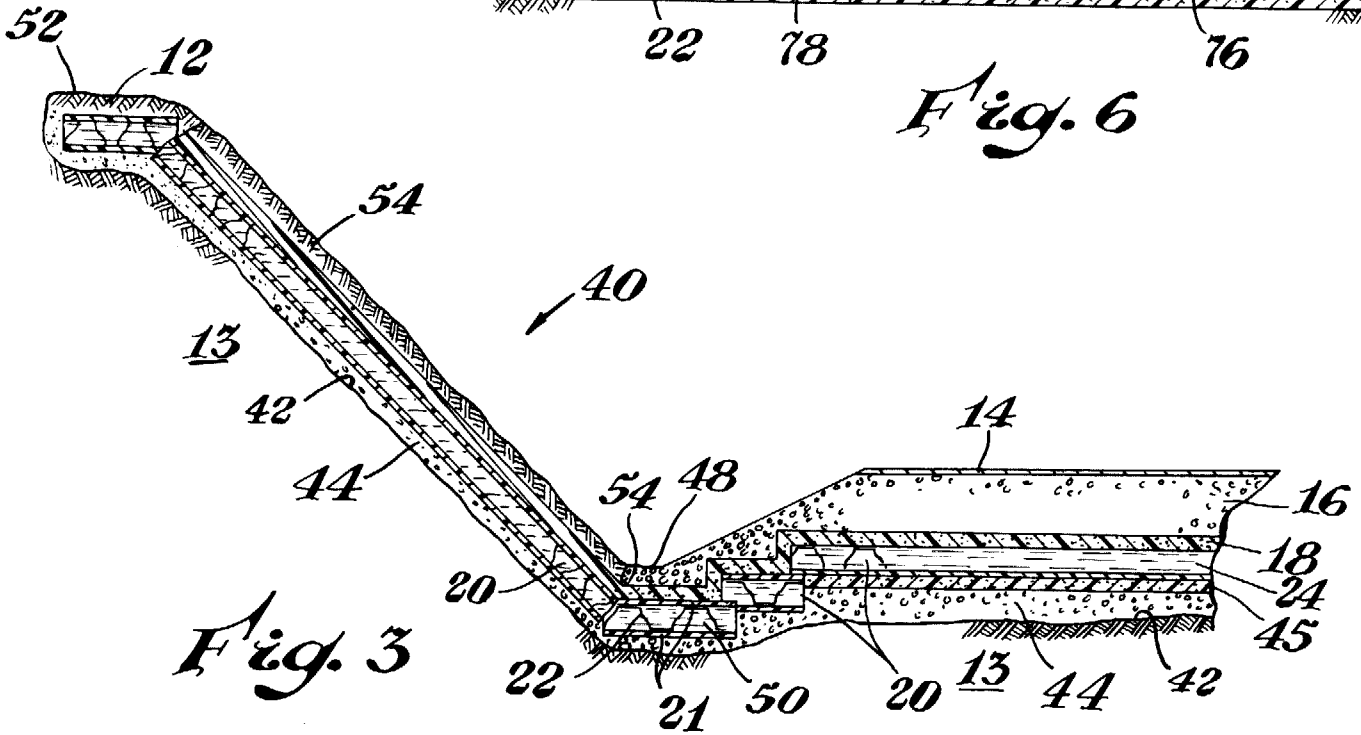
FIG. 3 is a cross half-section through a cut section for a trafficked surface with an adjacent backfill area constructed according to the principles of the present invention.

Yet another modification of the present invention is that of a cut section as illustrated, for example, in FIG. 3. Here the cut section 40 is cut deeply through the tundra layer 12 and into the underlying permafrost layer 13 which might typically be the case where a roadway is being built along a hillside or on other unlevel terrain. The permafrost 13 is cut back generally to the line 42 and a leveling gravel layer 44 is placed over the cut away section on top of the permafrost 13. optionally included is an insulation layer 45 much like layer 18, below uppermost heat sink 20 in foundation 16, to provide for effective refreezing of the permafrost 13, if the latter had been partially thawed prior to construction of the foundation. But for the fact that the foundation for the traffic surface 14 does not lay on any tundra and that there is a gravel leveling layer 44 and optional insulation layer 45 under the heat sink 20, the foundation 16 for the trafficked surface 14 is like that for the fill section 10 described earlier, and like reference characters are used to illustrate like components and functions.

In this case, additionally, the embankment 28 ends at a ditch 48 which has special problems of its own since a ditch is adapted to receive water and the water, because of the heat from the summer, can present a greater and more persistent potential thawing problem for the permafrost 13 therebelow. Accordingly, to take care of this special ditch problem a much larger heat sink 50, perhaps with half again as much capacity as a usual heat sink 20, might be employed under the ditch to absorb extra quantities of heat flowing through the insulation layer 18. Also, a thicker insulation layer could be used if more resistance to heat transfer is required.

Figure 4:
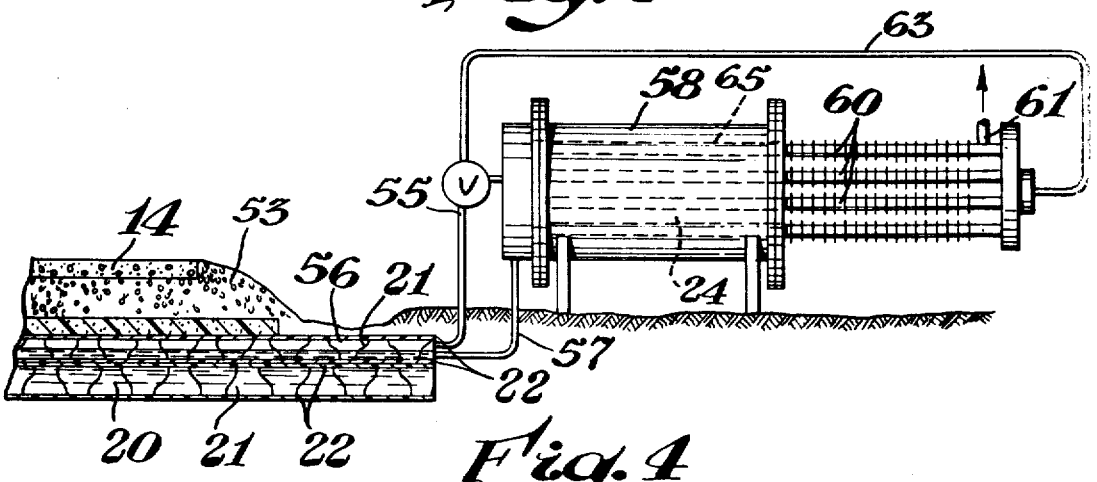
FIG. 4 is a cross half-section of a modified form of a trafficked surface foundation including a two phase transfer fluid thermal bleed as one foundation element.

Extending upwardly from the ditch line up backslope 53 to the original ground elevation level 52 and tundra 12, heat sinks 20 and insulation 18 can be placed over the gravel leveling layer 44 to prevent thawing along the backfill 53. This will prevent thawing of the higher embankment so that it does not fall into the ditch or interfere with traffic surface 14. On top of the insulation 18 along backslope 53 can be soil 54 which can support vegetation, or gravel, or any other finish surface for the backfill embankment as may be desired FIG. 4 is a modification of the section 10 embodiment of FIG. 1, wherein a foundation 53 includes a thermal bleed 56 employed between the insulation layer 18 and the heat sink 20. The thermal bleed 56 of FIG. 4 serves to provide extra dissipation of heat as might be experienced especially in the marginal areas between permafrost and seasonal frost regions. Here greater quantities of heat then normally would be expected in the colder climates can be particularly hazardous to the permafrost supporting the foundation for trafficked surfaces 14. To aid in the dissipation of such excess quantities of heat, a heat exchanger 58 and a condensing unit 60 can be employed acting cooperatively with a two phase heat transfer fluid 59 in thermal bleed 56. Also included under the heat sink 20 can be an insulation layer which serves again, as layer 45 previously described, to limit the heat flow associated with the refreezing of permafrost, which might have suffered some degradation before traffic surface and its foundation is applied thereto so heat flow to the heat sink is at a desired rate. The main difference here is the addition of the two phase thermal bleed 56 to the foundation. Thermal bleed 56 can be built like heat sink 20 but is filled with a two phase heat transfer fluid or dissipator 59, like a methyl bromide/methyl chloride mixture solution, having a boiling point, for example, of 20°F. to 32°F. at 760 mm. of mercury.

Figure 5:
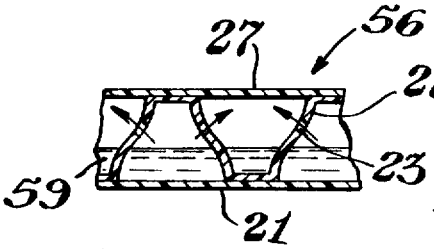
FIG. 5 is a detailed cross half-section of the thermal bleed of FIG. 4 containing such a transfer fluid.

Other suitable fluids for use in the present invention are materials such as dichlorodifluoromethane, sulfur dioxide, ethylchloride, trichlorofluoromethane, a 1:1 mixture of methyl bromide and methylchloride. Beneficially by employing such liquids the pressure within the thermal bleed can be maintained from about 5–25 pounds per square inch absolute and conventional pressure equipment avoided. This fluid can be filled to about half the level of thermal bleed 56. The thermal bleed 56 is connected to a tubular system 63 within heat exchanger 58 by an upper flow passage 55 in open communication with the upper non-liquid part of thermal bleed 56 and by lower passageway 57 in open communication with the lower liquid filled portion of thermal bleed 56 for return of condensed fluid 59. As shown more particularly in FIG. 5, openings 23 in core 22 allow the liquid to vaporize into the upper half of thermal bleed 56 and pass as a gas to passageway 55. The heat exchanger is filled about tubular system 65 with a naturally regenerative heat sink solution 24 which solution should have a freezing (phase change) point below the boiling point of two phase heat transfer fluid, or with cryogenic liquid or fluid cooled by mechanical refrigeration. Extending out from heat exchanger 58 are condenser elements 60 in open communication with tubular system 65. An optional heat exchange bypass line 63 can be used for winter operations, by operation of a two-way valve. In order to maintain a pressure system no greater than one atmosphere, a vent 61 for exhausting excess gases from tubular system 63 can form part of the condenser system so the components need not be designed to take high pressures without failure.

The two phase fluid 59 in the thermal bleed 56 boils at a temperature greater than that of the heat exchanger 58 so that when solar heat is absorbed through pavement 14 and foundation 53 the phase changes and the generated vapor passes through passageway 55 to the heat exchanger 58 in the summer months. Since the heat sink solution 24 is at a lower temperature than the boiled off gas, heat is absorbed from the gas with the result that the gas condenses and returns to the thermal bleed as a liquid. The heat exchanger thus works as a refrigerator during the summer months. During the winter months the gas passes through the heat exchanger into the condenser elements 60 where the cold air around the condenser elements 60 absorb heat from the gas, resulting in condensation of the gas and its return to the thermal bleed 56 via passageway 57.

Figure 6:
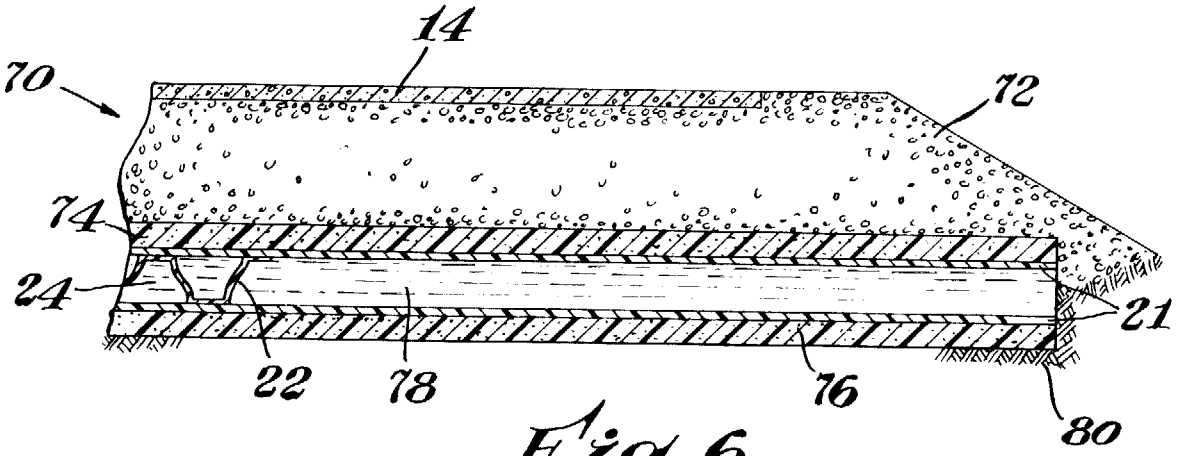
FIG. 6 is a cross half-section of a fill section for a trafficked surface employed in a seasonal frost region according to the principles of the present invention.

An application of the present invention to a seasonal regions is illustrated by the section 70 in FIG. 6. Again, a typical fill section is used wherein there is a traffic surface 14 supported on a foundation 72 comprising insulating layers 74 and 76 and a thermocell or heat sink 78. The insulation layers and heat can be as those previously described in FIGS. 1 and 3. However, their function is significantly different in the seasonal application. Here the ground 80 supporting the foundation is warmer than 32° and it is desired to protect this ground during the winter season so as to prevent disruptiong, such as heaving of the traffic surface 14 due to heat and the like as such problems are discussed in U.S. Pat. No. 3,250,188, for example. Again, this is essentially a borderline area use between seasonal frost and permafrost regions so that the seasonal application is considered to be supplemental to the more usual seasonal applications as contemplated by the aforesaid U.S. Pat. No. 3,250,188. Heat sink 78 in this application contains a fluid 82 which has a phase change temperature of at least 32°F., or in any event, greater than thawing temperature of the ground 80 so that the latent heat of fusion of the solution can absorb the cold, i.e., lose heat without causing the ground 80 to lose heat. The heat sink can be designed so that by the end of the winter it will just about freeze and then when the summer comes it can again thaw, i.e., be regenerated so as to be able to lose heat during the next winter. The lower insulation layer 76 assures that the interface between the soil and the protection system will be greater than 32°F. The upper insulation layer 74 is optional depending on the severity of the summer season to which this section 78 will be subjected.

While certain representative embodiments and details have been shown for the purpose of illustrating the invention, it will be apparent to those skilled in the art that various changes and modifications can be made therein without departing from the spirit and scope of the invention. For example, various combinations of heat sinks, insulation layers, and/or thermal bleeds described hereinabove can satisfy special applications not specifically mentioned above and still come within the scope of this invention as claimed. Likewise the thermal bleed with heat sink/condensers can find year round use for special applications in and of itself.

Accordingly, what is claimed as new is:

1. In a structure supported by permafrost earthen material and operational in primarily warmer climatic seasons to maintain the permafrost in a substantially frozen condition, a thermal bleed comprising a heat dissipator element containing a two phase heat exchange fluid, and a heat exchanger including means through which said heat exchange fluid can pass during the warmer climatic seasons for condensation and return, said heat exchanger containing a naturally regenerative heat sink material having a phase change temperature below the boiling point of said heat exchange fluid, said heat sink material being located about and in contact with said means heat exchange fluid passage to permit heat transfer therebetween, a condenser means in open communication with said thermal bleed during the below freezing climatic season, whereby said heat exchange fluid is transmitted to said condenser means, is condensed and returned to said thermal bleed during such below freezing climatic season.

2. The structure of claim 1 wherein a heat sink thermocell is located below said thermal bleed and contains a heat sink fluid having a phase change temperature substantially no greater than that of the permafrost earthen material, said heat sink being of sufficient capacity to remain substantially frozen during the warmer climatic season.

* * * * *